US009650739B2

(12) United States Patent
Baratta et al.

(10) Patent No.: US 9,650,739 B2
(45) Date of Patent: May 16, 2017

(54) GRADUAL-RELEASE DOSING DEVICE AND SEAL OF A DOMESTIC-USE APPARATUS

(71) Applicant: Reckitt Benckiser N.V., WT Hoofddorp (NL)

(72) Inventors: Carla Baratta, Trento (IT); Federico Della Negra, Padua (IT); Stefano Maretto, Mira (IT); Liliana Oliva, Summaga di Portogruaro (IT); Montserrat Riera, Trento (IT); Antonietta Tomasulo, Trento (IT)

(73) Assignee: Reckitt Benckiser Calgon B.V., WT Hoofddorp (NL)

( * ) Notice: Subject to any disclaimer, the term of this patent is extended or adjusted under 35 U.S.C. 154(b) by 331 days.

(21) Appl. No.: 13/886,435

(22) Filed: May 3, 2013

(65) Prior Publication Data

US 2013/0243661 A1 Sep. 19, 2013

Related U.S. Application Data

(63) Continuation of application No. 13/640,020, filed as application No. PCT/GB2011/050710 on Apr. 11, 2011, now abandoned.

(30) Foreign Application Priority Data

Apr. 12, 2010 (GB) ..... 1005963.2

(51) Int. Cl.
*B01D 11/02* (2006.01)
*A61L 2/00* (2006.01)
(Continued)

(52) U.S. Cl.
CPC ..... *D06F 39/02* (2013.01); *B60J 10/08* (2013.01); *Y10T 29/49826* (2015.01)

(58) Field of Classification Search
CPC ... A61L 2/00; A47L 15/00; C01F 1/68; E04H 4/00
(Continued)

(56) References Cited

FOREIGN PATENT DOCUMENTS

GB 2346904 A 8/2000
IT WO 2009/037669 A2 * 3/2009 ..... D06F 39/02
(Continued)

OTHER PUBLICATIONS

International Search Report for PCT/GB2011/050710 dated Nov. 3, 2011.

(Continued)

*Primary Examiner* — Monzer R Chorbaji
(74) *Attorney, Agent, or Firm* — Norris McLaughlin & Marcus PA

(57) ABSTRACT

Gradual-release dosing device for at least one substance in a domestic-use apparatus comprises the presence of a water based work fluid, characterized in that it comprises a casing (2) within which a plurality of doses of said substances (3) is contained, necessary for the corresponding plurality of operation cycles of said apparatus. Said casing (2) being at least partly defined by a material perrreable to said work fluid and capable of releasing at least a dose of said substance (3) at each operation cycle of the apparatus. The substance comprises at least one washing-active, dishwashing-active or cleaning-active preparation from the group consisting of surfactants, builders, water softening agents, zeolites, silicates, polymers, carbonates, carboxylates, sulphonates, bleaching agents, bleach activators, bleach stabilizers, bleach catalysts, cobuilders, alkalizing agents, acidifying agents, redeposition inhibitors, dyes, fragrances, optical is brighteners, UV filters, fabric softeners, and rinse agents.

25 Claims, 6 Drawing Sheets

(51) Int. Cl.

| | |
|---|---|
| ***B08B 3/00*** | (2006.01) |
| ***B65D 51/16*** | (2006.01) |
| ***B65G 59/00*** | (2006.01) |
| ***B67D 5/56*** | (2006.01) |
| ***D06F 39/02*** | (2006.01) |
| ***B60J 10/08*** | (2006.01) |

(58) Field of Classification Search
USPC .... 422/261, 264, 274, 292, 300; 134/50, 93; 222/129, 478; 221/92; 220/361
See application file for complete search history.

(56) References Cited

FOREIGN PATENT DOCUMENTS

| | | | |
|---|---|---|---|
| WO | 2005077064 | A2 | 8/2005 |
| WO | 2009037669 | A2 | 3/2009 |

OTHER PUBLICATIONS

Written Opinion of the International Searching Authority for PCT/GB2011/050710 dated Nov. 3, 2011.
GB Search Report for GB 1005963.2 dated Aug. 12, 2010.

* cited by examiner

GRADUAL-RELEASE DOSING DEVICE AND SEAL OF A DOMESTIC-USE APPARATUS

This is a Continuation patent of U.S. Ser. No. 13/640,020, which in turn is an application filed under 35 USC 371 of PCT/GB2011/050710.

The object of the present invention is a gradual-release dosing device of substances in both electric and non-electric apparatuses for domestic use which require in particular the periodic presence of water for the operation thereof In particular, such invention may be applied in some household electric appliances, for example washing machines or dishwashers, for the release of additive substances during different successive operation cycles, preferred reference whereto will be made in the following by way of example only.

As known, before starting each washing cycle the use pours into the suitable trays, into the dedicated compartment, or into the containers to be introduced directly into the basket, the detergent and other additives, such as for example fabric softener, bleach, antibacterial or antiscale agents.

The market offers an increasingly larger number of products which are soluble or may be suspended in wash water, to be added to the ordinary detergent before the traditional washing eye 1*e*, suited to improve wash efficiency or to safeguard the condition of the household electric appliance. In order to obtain the desired results, however, the user must remember to add the above said substances at each washing cycle, but sometimes, especially with some products, this does not occur due to the user's laziness or distraction.

The antiscale agent, in particular, is a product which the user often forgets to introduce, since it performs a preventative action and hence does not give the user an immediate and practical confirmation, as may instead occur with the softener which makes washed items softer, or bleach which makes the laundry brighter, or dishwasher fragrance diffusers which remove unpleasant odours, or rinse aid which improves dishes polish. These substances cause effects which the user immediately detects with his/her senses and they encourage him/her to make constant use thereof.

Moreover, not all household electrical appliances intended for washing have a dedicated compartment for antiscale introduction, since the problem of the scale deposit on the mechanical components of household electric appliances depends on the user's geographical area, and not all water types have such a hardness index to require a methodical use of an anticscale product.

Similar omissions by the user also regard other products such as for example antibacterial products or the products capable of preserving and cleaning mechanical components of the household electrical appliance such as gaskets, holes for water introduction or pipes carrying the detergent into the wash basket.

Similarly, in sanitary appliances such as the toilet, products are frequently added to preserve hygiene and cleanliness of the toilet bowl.

Such products may be poured manually and periodically into the toilet bowl, but their effectiveness and their stay in the toilet are limited in time due, in particular, to the use of the flusher, and a continuous application of the same is therefore necessary.

In this situation, the technical object underlying the present invention is to propose a gradual-release dosing device of substances in domestic-use apparatuses requiring the presence of water for the operation thereof, capable of avoiding the above cited drawbacks.

In the framework of said technical task, it is the main object of the present invention to provide a gradual-release dosing device of substances in domestic-use appliances requiring the presence of water which is easy and practical to use and which prevents the user from forgetting to introduce, at each wash or in general at each use of the appliance, any type of substance which may be necessary or useful for better operation of the appliance.

Another object of the invention is to provide a gradual release dosing device of substances in sanitary appliances such as, for example, the toilet, which may be used for varions operation cycles of appliance.

A further object of the present invention is finally to provide a gradual-release dosing device of substances in domestic-use appliances, which may be used in the appliances of this type already on the market.

The detailed technical task and the specified objects are substantially achieved by means of a gradual-release dosing device of substances in domestic-use appliances, characterised in that it comprises the technical features of one or more of the enclosed claims.

The substance held within the device depends, of course, on the intended use of the device. It may, for example, contain surface active agents such as an anionic, nonionic, cationic, amphoteric or zwitterionic surface active agent or mixture thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols.

Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_2(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_2(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a C8-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$-$C_{18}$ fatty acids, especially the sodium potassium or alkanolammonium salts, and alkyl, for example $C_8$-$C_{18}$, benzene sulfonates.

Examples of nonionic surfactants are fatty acid alkoxylates. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, no nionic ethoxylate/propoxylated condensates with propylene glycol, and the nonionic ethoxylate condensation products with propylene oxide/ethylene diamine adducts. Preferred fatty acid ethoxylates, are especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, or $C_{12}$-$C_{14}$ alkyl group and n is at least I, for example from 1 to 16, preferably 2 to 12, more preferably 3 to 10.

The alkoxylated fatty alcohol nonionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodoll-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about I0 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average oft moles of ethylene oxide per mole of fatty alcohol.

Other examples of suitable ethoxylated alcohol nonionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated nonionic surfactants are Neodol 45-1 I, which is a similar ethylene oxide condensation products of a fatty alcohol having 14-15 carbon atoms and the number of ethylene oxide groups per mole being about 1 1. Such products are also available from Shell Chemical Company.

Further nonionic surfactants are, for example, $C_{10}$-$C_{18}$ alkyl polyglycosides, such s $C_{12}$-$C_{16}$ alkyl polyglycosides, especially the polyglucosides. These are especially useful when high foaming is desired. Further surfactants are polyhydroxy fatty acid amides, such as $C_{10}$-$C_{18}$ N-(3-methoxypropyl)glycamides and ethylene oxide-propylene oxide block polymers of the Pluronic type.

Examples of cationic surfactants are those of the quaternary ammonium type.

Preferred quaternary ammonium compounds have the formula (I) or (Ia), or include a mixture thereof;

$$[R'—(CO)O—R—N'(—R'')(—RO)_1H)(—R—O—(COR')]X \quad (I)$$

$$[R'—(CO)—NH—R—N^+(—R^1)(—(RO)_1H)(—R—NH—(CO\}R')]X \quad (Ia)$$

wherein:

R is an alkylene or alkenylene group having 2 to 4 carbon atoms;

R' is an alkyl or alkenyl group lnving 8 to 22 carbon atoms;

n is an integer having a value of 1 to 4;

R" is an alkyl group having I to 4 carbon atoms; $R^1$ is an alkyl group having I to 4 carbon atoms or hydrogen; and X— is a softener-compatible anion.

Non-limiting examples of softener-compatible anions (X) include chloride, formate, nitrate, sulfate or $C_{1-4}$ alkyl sulfate, preferably methyl sulfate.

The alkyl or alkenyl R' ideally must contain at least 10 carbon atoms, preferably at least 14 carbon atoms, more preferably at least 16 carbon atoms. The group may be straight or branched.

A specific example of quaternary ammomum compound is di-(tallow carboxyethyl)hydroxyethylmethyl ammoniumX.

A cationic fabric co-softener may be present.

Examples of amphoteric surfactants are $C_{10}$-$C_{18}$ amine oxides and the $C_{12}$-$C_{18}$ betaines and sulfobetaines.

Suitable builders are alkali metal or ammonium phosphates, polyphosphates, phosphonates, polyphosphonates, carbonates, bicarbonates, borates, polyhydroxysulfonates, polyacetates, carboxylates such as cit rates and other polycarboxylates/polyacetyl carboxylates such as succinate, malonate, carboxymethyl succinate.

There are three main types of method of action for water-softening agents, described below.

1) Ion exchange agents-such agents include alkali metal (preferably sodium) aluminosilicates either crystalline, amorphous or a mixture of the two. Such aluminosilicates generally have a calcium ion exchange capacity of at least 50 mg CaO per gram of aluminosilicate, comply with a general formula:

$$0.8\text{-}1.5Na_2O.Al_2O_3.\ 0.8\text{-}6SiO_2$$

and incorporate some water. Preferred sodium aluminosilicates within the above formula contain 1.5-3.0 $SiO_2$ units. Both amorphous and crystalline aluminosilicates can be prepared by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, and mixtures thereof. Also of interest is zeolite P described in EP 384070 (Unilever).

Another class of compounds are the layered sodium silicate builders, such as are disclosed in U.S. Pat. No. 4,464,839 and U.S. Pat. No. 4,820,439 and also referred to in EP-A-551375.

These materials are defined in U.S. Pat. No. 4,820,439 as being crystalline layered, sodium silicate of the general formula $NaMSi_xO_{2x+1}.YH_2O$ wherein M denotes sodium or hydrogen, x is from 1.9 to 4 and y is from 0 to 20.

Quoted literature references describing the preparation of such materials include Glastechn. Ber. 37, 194-200 (1964), Zeitschrift ftir Kristallogr. 129, 396-404 (1969), Bull. Soc. Franc. MM. Crist., 95, 371-382 (1972) and Amer. Mineral, 62, 763-771 (1977). These materials also function to remove calcium and magnesium ions from water, also covered are salts of zinc which have also been shown to be effective water softening agents.

2) Ion capture agents—agents which prevent metal ions from forming insoluble salts or reacting with surfactants, such as polyphosphate, monomeric polycarboxylates, such as citric acid or salts thereof, polycarboxylate polymers, such as polyacrylates, acrylic/maleic copolymers, and acrylic phosphonates, EDTA, algins, alginates.

3) Anti-nucleating agents—agents that prevent seed crystal growth, such as polycarboxylate polymers, such as polyacrylates, acrylic/maleic copolymers, and acrylic phosphonates, and sulfonates. Such polymers may also act as ion capture agents as well.

Preferred organic water-soluble water softening agents which may be present include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates, hydroxyethyliminodiacetates, phosphonates, iminodisuccinates, polyaspartic acids, BHT, phosphonate stabilisers such as, diethylenetriaminepenta (methylene phosphonic acid and its corresponding pentasodium salt) available under the trade names Dequest 2060 and Dequest 2066 Monsanto Chemical Co), DTPMP and DTPMA (Dequest 2010) and HEDP.

Preferably the water-soluble water softening agent is a neutralised or partially neutralised carboxylic acid, such as citric acid, succinic acid or maleic acid, and/or a neutralised or partially neutralised polycarboxylic acid, such as a polyacrylate of Mw: 4000-8000 (such as Acusol445N (Rohm & Haas) CAS REG Nr. 66019-18-9 or Sokalan from BASF).

Further examples of such suitable polymers include polymers based on an unsaturated sulphonic acid monomer. The unsaturated sulphonic acid monomer is preferably one of the following: 2-acrylamido methyl-1-propanesultonic acid, 2-methacrylamido-2-methyl-1-propanesulphonic acid, 3-methacrylamido-2-hydroxypropanesulphonic acid, allysulphonic acid, methallysulphonic acid, allyloxybenzenesulphonic acid, methallyloxybenzensulphonic acid, 2-hydroxy-3-(2-propenyloxy)propanesulphonic acid, 2-methyl-2-propene-1-sulphonic acid, styrene sulphonic acid, vinylsulphonic acid, 3-sulphopropyl acrylate, 3-sulphopropyl methacrylate, sulphomethylacrylamid, sulphomethylmethacrylamide, and water soluble salts thereof.

The unsaturated sulphonic acid monomer is most preferably 2-acrylamido-2-propanesulphonic acid (AMPS).

Suitable enzymes include proteases, lipases, amylases and cellulase enzymes. Such enzymes are commercially available and sold, for example, under the registered trade marks Esperase, Alcalase, Savinase, Termamyl, Lipolase and Celluzyme by Nova Nordisk AJS. When present desirably the enzymes are present in the substance in an amount of from 0.5 to 3 wt %, especially I to 2 wt %.

The substance may, if desired, comprise a thickening agent or gelling agent Suitable thickeners are polyacrylate polymers such as those sold under the trade mark CARBOPOL, or the trade mark ACUSOL by Rohm and Hass Company. Other suitable thickeners are xanthan gums. The thickener, if present, is generally present in an amount of from 0.2 to 4 wt %, especially 0.2 to 2 wt %.

The substance can also optionally comprise one or more additional ingredients. These include conventional detergent components such as further surfactants, bleaches, bleach enhancing agents, builders, suds boosters or suds suppressors, anttarnish and anti-corrosion agents, organic solvents, co-solvents, phase stabilisers, emulsifying agents, preservatives, soil suspending agents, soil release agents, germicides, phosphates such as sodium tripolyphosphate or potassium tripolyphosphate, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners, and perfumes. If used, such optional ingredients will generally constitute no more than I0 wt %, for example from 1 to 6 wt %, the total weight of the substance.

For a substance which comprises an enzyme materials may optionally be present to maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.1 to 1 wt % of the substance.

The substance may optionally comprise materials which serve as phase stabilizers and/or co-solvents. Example are $C_1$-$C_3$ alcohols or dials such as methanol, ethanol, propanol and 1,2-propanediol. $C_1$-$C_3$ alkanolamines such as mono-, di- and triethanolamines and monoisopropanolamine can also be used, by themselves or in combination with the alcohols.

If the substance is in liquid form, it may be anhydrous, or, for example, contain up to 5 wt % water. Aqueous substances generally contain greater than 8 wt % water based on the weight of the aqueous substance. Desirably the aqueous substances contain more than 10 wt %, 15 wt %, 20 wt %, 25 wt % or 30 wt % water, but desirably less than 80 wt % water, more desirably less than 70 wt %, 60 wt %, 50 wt % or 40 wt % water. They may, for example, contain from 30 to 65 wt % water.

The substance may optionally comprise components which adjust or maintain the pH of the substance at optimum levels. Examples of pH adjusting agents are NaOH and citric acid. The pH may be from, for example, I to 13, depending on the nature of the substance.

The substance may be for use as a fabric detergent, fabric additive, fabric conditioner, water softening agent, or as a dishwasher detergent/additive in an automatic washing machine (for laundry items or other items such as houseware/crockery/cutlery).

The device may be used complimentary to one or more other detergents which have been added into the automatic washing machine by the use of whatever dosing chambers are present and/or by a user simply placing an amount of detergent into the body of the machine.

Most preferably the substance is for use in an automatic washing machine as a water softening agent. As such in a preferred embodiment the device is intended to be used with an automatic clothes washing machine for release of a water softening agent into the wash liquor of the machine. Most preferably the device is intended to be disposed in or adjacent to a gasket/door/lid of such a washing machine.

Most preferably the water softening substance comprises a water softening agent such as one of the builder agents described above.

The water softening substance may be present in the device as a solid (e.g. as a particulate, in compressed particulate form (such as a tablet) or some other moulded form (such as a cake or bar)), a liquid (e.g. a flowable liquid, gel or solidified gel) or an admixture of one or more forms.

Preferably the substance is substantially free from any fabric softening actives, surfactant, and/or bleach. By substantially herein free we mean <15% wt, <12% wt, <10% wt, <8% wt, <6% wt, <4% wt, <2% wt, <1% wt, <0.5% wt, <0.1% wt, <0.01% wt of each and any combination or all of the ingredients listed above.

Preferably a builder/water softening agent is present in the water softening substance in an amount of I to 95% wt. Preferably a builder/water softening agent is present in the water softening substance in an amount of at least 5, 10, 15, 20, 30, 35, 40, 45, 50, 55, 60, 65, 70, 75, 80, 85, 90% wt. Preferably a builder/water softening agent is present in the water softening substance in an amount of at most, of 5.0, 90, 85, 80, 75, 70, 65, 60, 55, 50, 45, 40, 35, 30, 25, 20, 15% wt.

For a liquid water softening substance preferably the pH of the substance is at least 0.5, 0.9, 1.0, 1.3, 1.5, 1.7, 1.9, 2.1, 2.3, 2.5, 2.7, 2.9, 3.0, 4.0 or 5.0 and, at most, of 5.0, 4.0, 3.5, 3.3, 3.2 or 3.1.

Preferred examples of suitable water softening substances are below.

| Raw Material | Percentage | Percentage | Percentage | Percentage |
|---|---|---|---|---|
| Water | 30.72 | | | |
| Acusol445 (48%) | 33.65 | 33.65 | | |
| Pigmosol6900 (1%) | 0.4 | 0.4 | | |
| Sokala PA30CL PN (92%) or Acusol445G (92%) | 7.4 | 7.4 | 17.56 | 17.56 |
| Citric Acid | 15 | 15 | | 15 |
| MEA | 11.5 | 11.5 | | |
| $Na_2$, $SO_3$, (15%) | 1.33 | 1.33 | | |
| Glycerine | | 8 | | |
| PEG400 | | 7.72 | | |
| MPG | | 15 | | |
| $Na_2S0_4$ | | | 82.44 | 67.44 |

Preferably the device is constructed such that it has an internal volume for placement of the substance of around 150 crrf. (Obviously it will be appreciated that to a degree the overall size of the device is influenced by the automatic washing machine with which it is intended to be used).

The internal volume may vary from 50 to 250 crrf, more preferably 75 to 225 $cm^3$, more preferably 100 to 200 $cm^3$, more preferably 125 to 175 $cm^3$.

To achieve this general volume the device generally has a length of about 50 cm and a width of from 1-3 cm, e.g. 2 cm. With such a length it is envisaged that the device has a length such it approximately encompasses around 50% of the circumference of the door/gasket a European style front-loader automatic clothes washing machine. The length/and or width may be altered as necessary for different machines and/or so that the device is able to encompass the entire circumference of the door/gasket of an automatic clothes washing machine.

Generally it is envisaged that approximately 10 g of water softening substance is released into a wash cycle of an automatic clothes washing machine. This amount may be varied and may be between 5 g to 25 g per wash cycle, e.g. 7 to 20 g or more preferably 8 to 15 g.

As such it is envisaged that the device can be used over a number of wash cycles to release a water softening agent without being replaced/refilled. A typical number of wash cycles is from 5 to 20 cycles, more preferably from 8 to 15 wash cycles, and most preferably from 8 to 12 wash cycles.

The device is preferably designed so that it can be recharged after use. The device is preferably designed so that it displays an end-of-use indicator to a user, e.g. a colour change or visibility window.

In all embodiments of the present invention one compartment may contain, for example, a liquid or solid component (such as a powder, granules or a compressed or gelled tablet) and another may contain a different liquid or solid component (such as a powder, granules or a compressed or gelled tablet). Alternatively, more than one component may be present in one or more compartments. For example a compartment may contain a solid component, for example in the form of a ball or pill (such as a powder, granules or a compressed or gelled tablet), and a liquid component.

A preferred exemplary non-limiting embodiment is now reported of a gradual-release dosing device for additive substances for a washing machine, according to the accompanying drawings, wherein:

FIG. 1 shows a perspective view of a device according to the present invention;

each of FIGS. 2A and 2B shows an enlarged portion of the device of FIG. 1;

A gradual-release dosing device of substances domestic-use appliances according to the present invention is shown in the enclosed figures under numerical reference 1.

By way of a non-limiting example, reference will be made in the following to the application of the dosing device of the invention to electric appliances and in particular to different types of washing machines.

Figure 1:
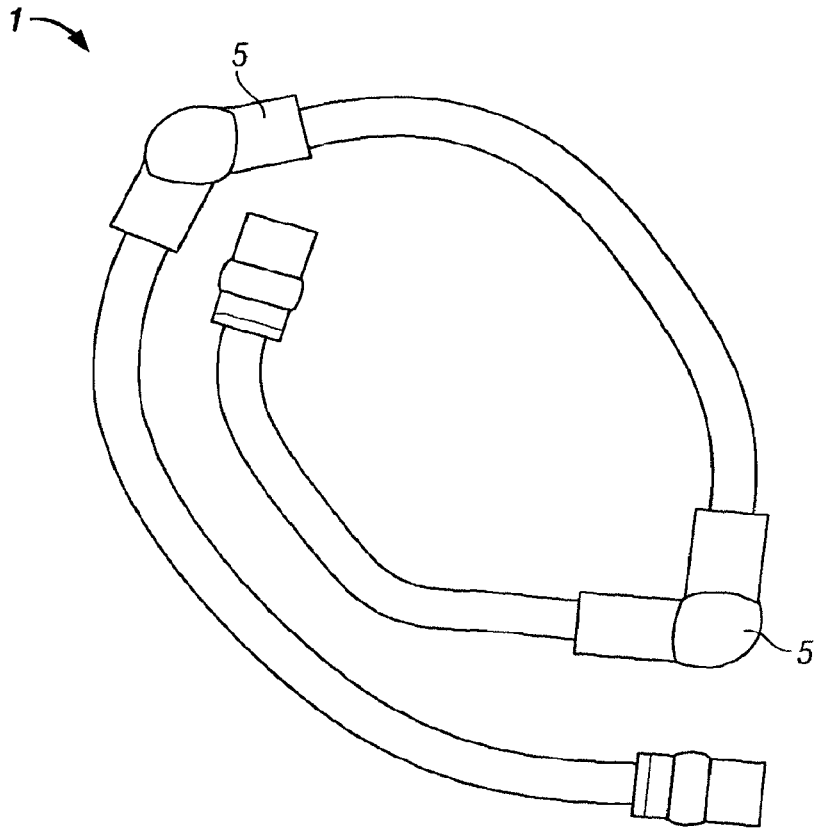

The device shown in FIG. 1 comprises an outer casing 2 within which an amount of one or more substances 3 is contained, such as antiscale, disinfectants or other similar additives, of course the substance or the mixture of substances contained within casing 2 may differ even widely from one application to the other, depending on the particular appliance to which the device is applied on the particular function which one wishes to accomplish in the same.

In the washing machine application disclosed here, these are preferably additive substances 3, to be added to the traditional detergent at each operation cycle of the electrical appliance.

The amount of additive substance 3 contained within casing 2 corresponds to more than a standard dose sufficient for a single operation cycle of the electrical appliance. A quantity equal to a plurality of doses is preferably contained, advantageously ranging between 10 and 500 doses, depending on the type of application and on the frequency of use, so as to have an actual dosing device duration from one to several months.

Casing 2 is at least partly defined by a water-permeable material, advantageously a natural or synthetic polymeric membrane. The material may have hydrophilic features, so as to promote water permeability, but it can also have hydrophobic features, provided its porosity is sufficiently high to allow a water permeability capable for allowing the desired dissolution of substance 3.

In particular it is a membrane which, upon contact with water, or more generically with a work fluid, for example water detergent, is capable of releasing at least one dose of the substance contained, during each operation cycle of the apparatus, for the entire duration of the useful life of the dosing device. Preferred exemplifying materials for membrane forming are: a cellulose-based hydropholic membrane, non-woven fabric, a porous polyethylene membrane, a mcroperforated polyethylene membrane, or a silicone membrane.

Preferably the membrane comprises a safety aperture.

With the use of such a safety aperture it has been found that disadvantageous swelling of the membrane device can be avoided/mitigated. Without wishing to be bound by theory it is postulated that with the use of such a safety aperture excessive uptake of water from the liquor of the automatic cleaning machine can be avoided. It is postulated that such water uptake arises due to the attraction of certain chemical components, particularly so for polymers based on acrylates/acrylic acid that may be contained in the device, to water from the wash liquor. Indeed in the first wash cycles it has been observed that the water uptake of the device may be higher than the water/chemical component release. Such uptake would ordinarily lead to excessive water uptake which could lead to dislodging of the device from its intended locus and/or damage to the device, preventing its further use.

The membrane may include a plurality of safety apertures.

Generally the safety aperture has a diameter of between I-100 μm, more preferably 10-90 μm and most preferably 20-60 μm It has been found that a safety aperture of such a size is ideal. Release of uptaken water is achieved without permitting unwanted release of the device contents.

To achieve an aperture of such a size specialised cutting equipment has been found to be required, e.g. such as laser cutting device. Indeed by the use of a laser cutting device it has been found to make such safety apertures, even when the membrane is filled with a liquid composition.

The safety aperture may preferably have a dispersible protective coating to form a shielding barrier before use to prevent premature release of contents of the device. A preferred material for such a coating is polyvinyl alcohol since this is able to achieve the level of protection required, yet is dispersible in an aqueous medium.

In the case disclosed here of an electric appliance such as the washing machine, the work fluid consists of the wash fluid. In the case of the sanitary appliance such as, for example, a toilet (not shown) instead, the work fluid comprises the water flowing in correspondence of the operation of the flusher normally provided in association with the toilet bowl.

By the term "dose" a certain amount of substance 3 is intended, which is a function of the type and/or of the duration of the washing cycle, or of the amount and/or temperature of the wash water, or again of the physical properties of the water.

For example, in the specific case of an antiscale additive substance, the amount or "dose" of released substance at each wash depends mainly on water hardness.

At the end of each operation cycle in casing 2, a left-over amount of substance 3 remains, ready to be partly released during a subsequent operation cycle, until depletion of substance 3.

The physical features of the membrane making up casing 2 are such as to keep substantially unchanged the chemical properties of the substance which remains within the casing at the end of the wash and so as to cause only a partial, progressive drop of the concentration of such substance or of the amount thereof-depending on whether said substance is initially in a liquid/gel or in a solid form—depending on the dose which is released into the apparatus during the different subsequent operation eyeles.

The membrane porosity level, and hence the water permeability thereof, substantially depends on the pore size of the material it consists of Porosity being equal, permeability may further vary depending on the hydrophilic/hydrophobic character of tie material the membrane consists of.

Casing 2 is flexible and deformable. Advantageously, dosing device I has an elongated tubular shape, preferably with a circular section.

The diameter of casing 2 ranges between 1 and 5 cm, and the entire device has a length preferably ranging between 20 and 200 cm. The ratio between length and diameter of casing 2 is hence preferably greater than 4, so as to guarantee a wide contact surface between the substance contained in casing 2 and the water which penetrates into the same during the operation cycles.

Figure 7:
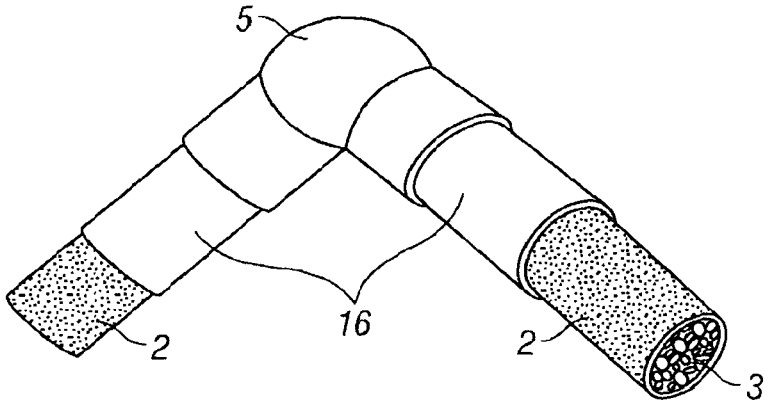
FIG. 7 shows a portion of a different embodiment of the device of FIG. 1.

An embodiment, shown in FIG. 7, provides that casing 2 formed by the polymeric membrane is at least partly covered by flexible, protective sheath 16. Such sheath 16 is preferably made of water-proof material, for example rubber, and has the purpose of protecting and of giving greater rigidity to the below-lying cellulose membrane, which membrane is particularly fragile in some areas, such as for example near bends or areas subject to greater friction. Protective sheath 16 has holes 17 or windows 18 to allow for controlled release of the substance.

Thus, between the cellulose membrane and sheath 16 a gap is formed (FIG. 7) into which water or the work fluid seep to remove the additive substance.

In an alternative, not-shown solution, outer casing 2 consists of a single layer of material made by sheath portions in a water-proof material separated by portions of cellulose membrane.

In some cases, casing 2 is initially covered also by a waterproof film or coating of water soluble material, to avoid leaks of active substance during the product storage period. Upon first use, the water soluble film or coating melts, thereby putting casing 2 directly in contact with water.

In other cases, casing 2 is initially covered by a peelable film, such as an aluminium barrier sheet, to prevent leaks of active substance during the product storage period. Upon first use, the user must firstly provide to remove the waterproof protective film.

The gradual-release dosing device I may be associated with an electrical household appliance, preferably with a washing machine, in a position which—during the operation of the electrical household appliance—is affected by the work fluid, i.e., by clean water or by water already containing detergent.

Moreover, device I may preferably be housed in a seat 4 of the device. Preferably, seat 4 should be easy to be inspected by the user. This is consideration of the fact that the user must be able to check the condition of the device and verify if any substance 3 is still found inside, or if the device must be replaced by a new one.

Advantageously, a charge depletion indicator of substance 3 may be provided, or an end-of-life indicator of the dosing device, i.e., an indicator, for example of a mechanical or electronic type, apt to emit a visual and/or sound signal when substance 3 has run out to the point that no release of a dose sufficient for each operation cycle is possible.

In a preferred embodiment, for example, the gradual depletion of the device may be detected by the user by using a coloured substance 3 and detecting the progressive discoloration thereof through casing 2, as the number of washings undergone by the device increases. Thereby the use is capable of perceiving easily when the charge of substance 3 has run out of device I must be replaced.

Along the longitudinal length of device I a joint 5, preferably two may be provided to be able to easily shape device I according to the geometry of the relative housing seat 4.

Figure 10A:
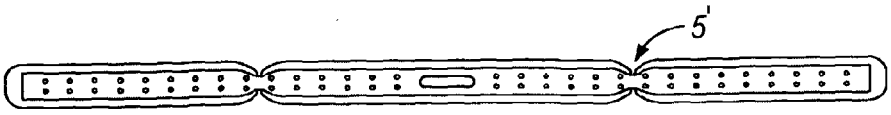
FIGS. 10A, 10B and 10C show respective top plan, side and bottom plan views of a different embodiment of the flexible, protective sheath according to the present invention.
Figure 10B:
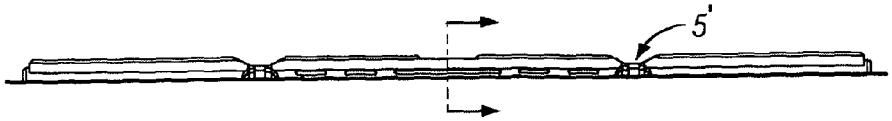
Figure 10C:
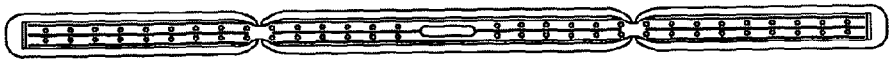
Figure 12A:
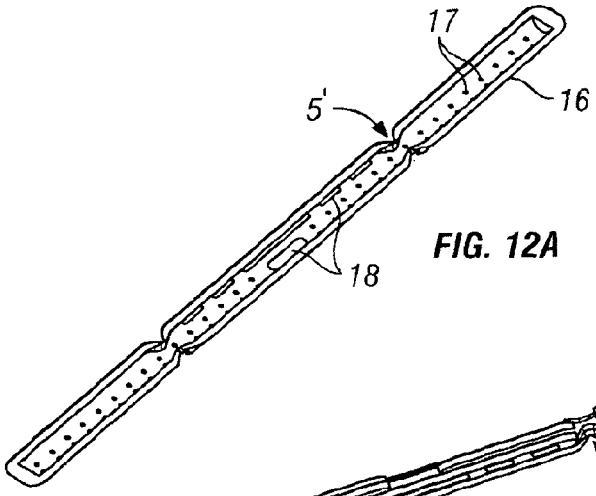
FIGS. 12A, 12B and 12C show respective top and bottom perspective views in an extended condition and again bottom views in a folded condition of the flexible, protective sheath of FIG. 10.
Figure 11:
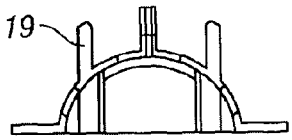
FIG. 11 shows an enlarged-scale cross section according to the line A-A of FIG. 10B.
Figure 12B:
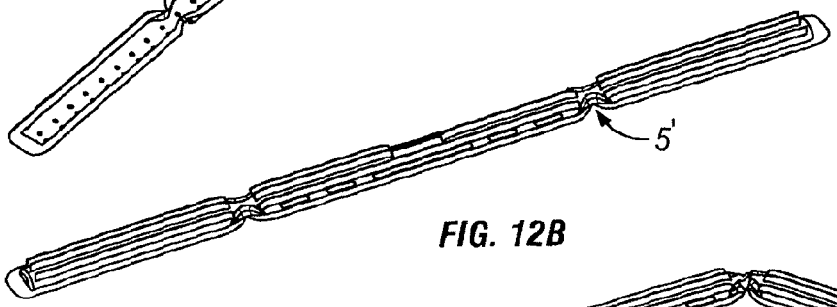
Figure 12C:
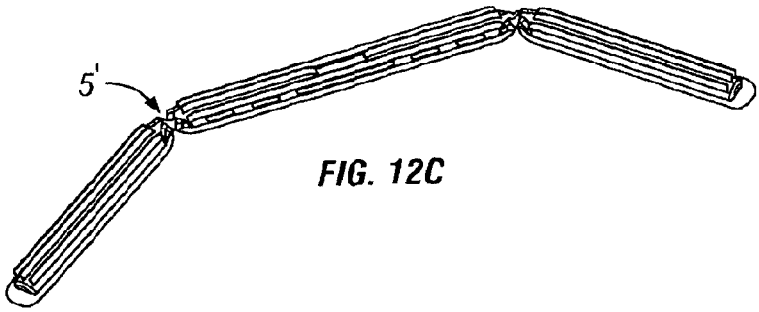

In another embodiment, shown in FIGS. 10-12, along protective sheath 16 there is provided at least one folding point 5' which also allows to shape the device according to the geometry of the relative housing seat 4.

In the case of the toilet, device I may be engaged with an annular groove facing towards the bottom of the toilet bowl and normally provided for the circulation of the flushing water.

In the case of a washing machine, advantageously, seat 4, with which the gradual-release device I of additive substances 3 may be engaged is an inner seal of the device.

Preferably, the seat 4 housing device I is outside the washing basket, in order to safeguard I both from the high centrifugal forces which develop within the basket, due to the high number of revolutions, and from the friction forces which originate inside the basket, due to the friction between garments.

Figure 3:
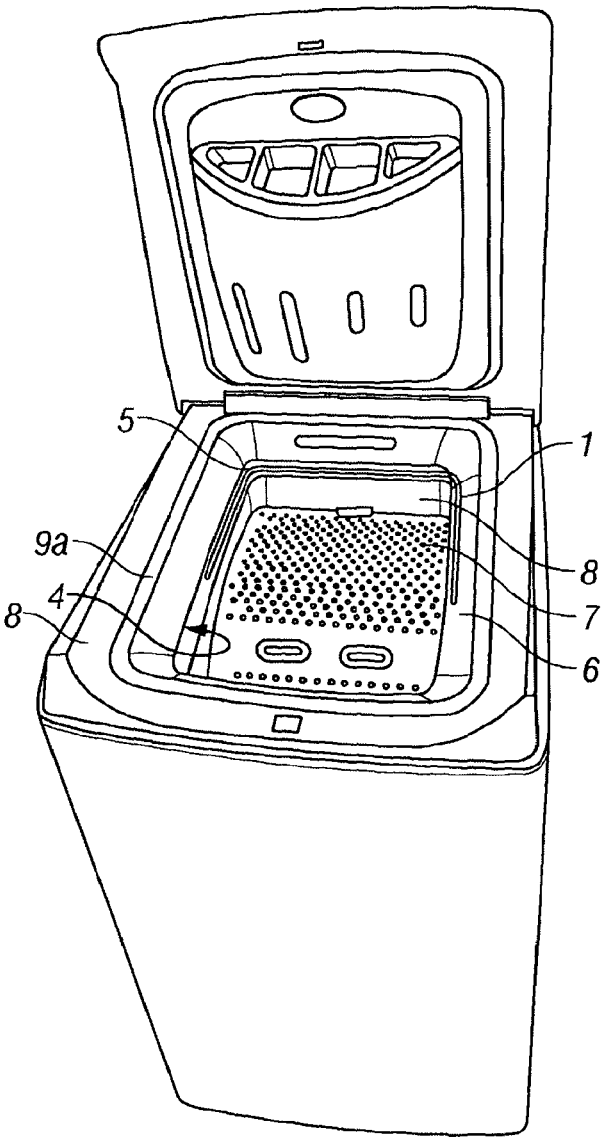
FIG. 3 shows a first application of the device of FIG. 1.

For example, FIG. 3 shows the device associated with a top-loading washing machine. In the specific case, the device is housed in a groove 6, found in the upper part of the washing machine, bounded by a seal which fully surrounds washing basket 7 and the inner surface of the outer structure 8 of the washing machine. In other words, the inner basket 7 of the washing machine is slung and kept suspended by an element 9 fastened to the outer structure, but capable of slight oscillations to dampen the abrupt basket movements. In the upper part of this element 9 a seal 9*a* is found which follows the rectangular, inner plant profile of the washing machine, and limits an opening which provides access to inner basket 7. Between this seal 9*a* and the inner surfact of outer structure 8 of the washing machine the cited groove 6 is found, within which device 1 may be housed.

To follow the polygonal geometry of housing seat 4, the device comprises one or more joints 5 which enable device I to form even square angles, without outer casing 2 to undergo any stress. In correspondence of such joints, the above described protective sheath 16 is advantageously provided in an alternative embodiment, said sheath being capable of easily maintaining the geometry of device I.

In another embodiment, in order to follow the polygonal geometry of the housing seat 4 thereof, protective sheath 16 comprises one or more folding points 5' which allow the device to form even square angles, without the inner casing undergoing any stress.

The water used for the wash affects also cited groove 6, and then falls back into the basket, carrying with itself part of substance 3 contained in casing 2.

Figure 4:
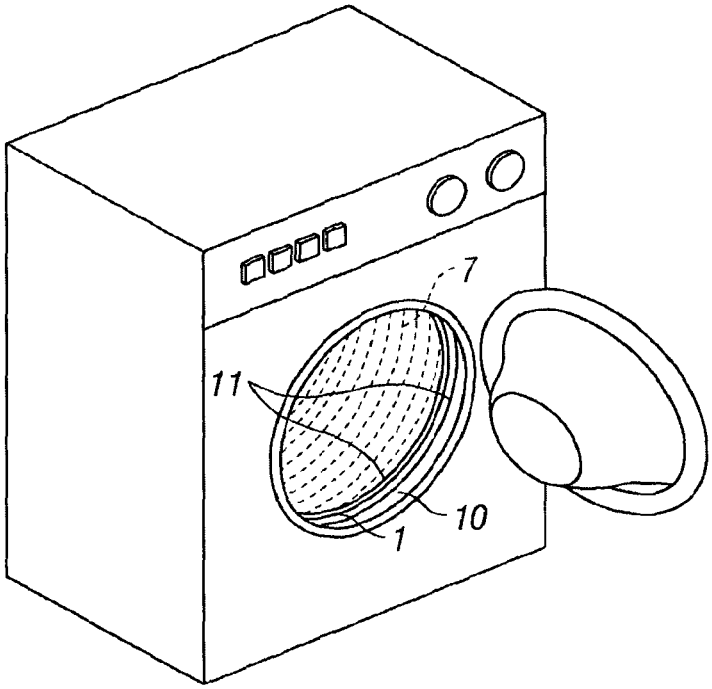
FIG. 4 shows a second application of the device of FIG. 1.
Figure 5:
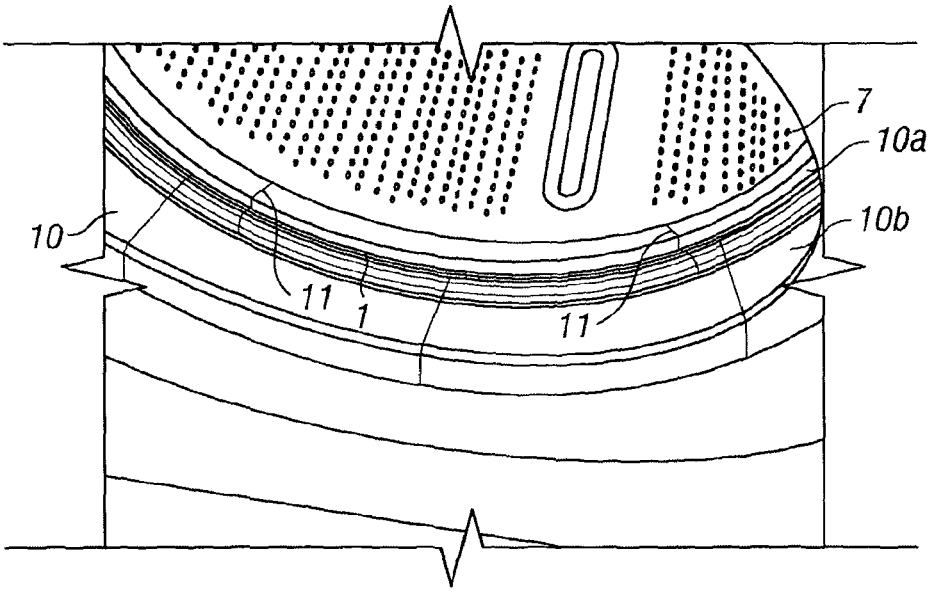
FIG. 5 shows an enlarged detail of a variant of the second application shown in FIG. 4.

FIG. 4 shows a second application of the device 1 of the present invention, and FIG. 5 shows a preferred variant of such second application.

In particular, FIGS. 4 and 5 show the device 1 associated with a front-loading washing machine. In both cases the device is housed at the mouth of the basket, in correspondence of the circular inner seallO surrounding the washing machine window.

Seal 10 has, along its entire upper surface, a groove lOa communicating with a groove lOb, inwards with respect to seal!O. The preferred solution in the case of a front-loading washing machine, shown in FIG. 5, provides that within the groove lOb of seal I0 device 1 is directly introduced.

Figure 2A:
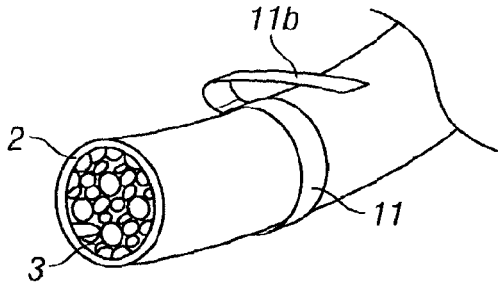
Figure 2B:
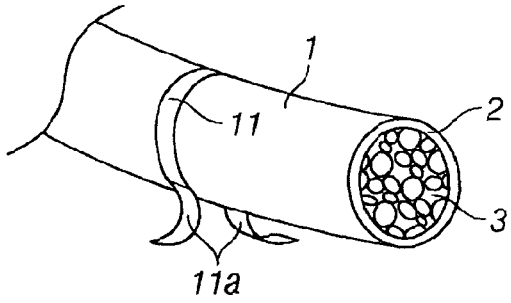

In an embodiment, device I is equipped with at least one fastening element II, shown in FIGS. 2A and 2B, capable of ensuring the correct positioning and the positive stability of device 1, especially for toilet flushing devices. In this case, for example, fastening element 11 engages hookwise with the side rim of the toilet bowl, being visible from the outside.

Alternatively, as shown in FIG. 4, device 1 may be rested on seal I0 kept in a position by cited fasting element 11, which this time is introduced into the seal, for example engaging hookwise with the seal lip.

More in detail, in this last case, device 1 remains inside the electric household appliance but outside the wash basket, so as not to be affected by the centrifuge forces and only marginally undergoing the action of the friction forces due to the laundry chafing.

Preferably, two or more fastening element II are provided, clearly shown in FIGS. 2A and 2B, which comprise, for example, rings surrounding casing 2 equipped with flaps 11*a*, as shown in FIG. 2A, which engage with groove IOa provided on seal IO or rings surrounding case 2 provided with clips 11*b*, as shown in FIG. 2B, which fasten to the side rim or lip seal 10. Similar fastening elements 11 may be mounted by the user if needed. Should device 1 be installed on top-loading washing machines, fastening elements 11 may possibly be removed; however, the use thereof guarantees a greater stability or device 1.

In alternative embodiments, shown in FIGS. 10-12, the fastening of the device to the seal is accomplished by the friction between longitudinal ribs 19 of the protective sheath and the seal.

Substance 3, contained within casing 2, may alternatively be entirely in a single form, for example a liquid or gel, or a solid powder or pellet (both fluid and agglomerated) form, or it may comprise a liquid or gel part within which powder or pellets of other solid substances are dispersed.

In a preferred embodiment, the substance is of a single type, for example exclusively an antiscale or antibacterial product. In alternative embodiments the substance comprises an array of multiple products mixed together.

Alternative embodiments provide for example the presence of fragrance particles, dispersed within the substance contained in the casing, capable of releasing a pleasant fragrance into the washing machine, removing the odours due to the dampness constantly found in the basket.

In use, when device 1 is affected by the work fluid of the household device or of the electric household appliance, casing 2 releases substance 3 in a suitably dosed amount. The amount of released substance in each operation cycle of the electric household appliance may be adjusted as desired by acting on the porosity of the membrane which makes up casing 2. Moreover, as mentioned above, casing 2 may be partly covered by a water-proof sheath 16, thereby limiting water inlet, in the gap forming between said sheath 16 and casing 2, to the sole areas where sheath 16 is missing.

Figure 6:
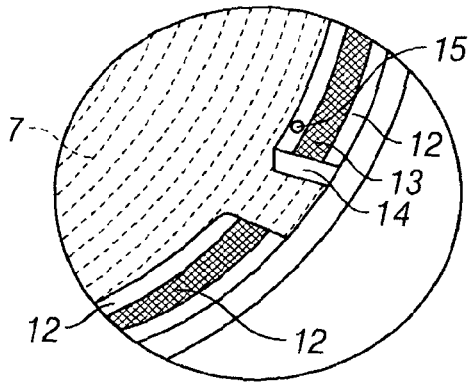
FIG. 6 shows a partly sectioned portion of a seal for a washing machine, comprising a device according to the present invention, integrated in the same seal.

Advantageously, a seal 12 is a further object of the present invention, said seal being shown in FIG. 6, which acts as a gradual-release dosing device for additive substances in a washing machine. Such seal comprises a casing 13 made of permeable material, within which at least an substance 14 is contained, at least one dose of which is released during an operation cycle of the electric household appliance. Casing 13 is rechargeable and for such purpose has at least one inlet 15 through which it is possible to fill seal 12 when contained substance 14 is depleted.

In this case too substance 14, identical to substance 3 described above, may be in a liquid, gel, or solid form, or a combination of such forms.

The present invention reaches the set objects.

As a matter of fact, the device of the present invention is easy and practical to use, since it is simply housed within ti'e electric household appliance or in the household device, without any problem any very quickly. Once positioned in the respective seat, the device is inconspicuous and does not cause any problem to the user, in particular both during loading and during emptying of the electric household appliance.

The amount of substance contained within the casing is such as to last for a certain number of washes or rinses, so that the user does not need to remember, in particular at each wash, to introduce certain additive substances such as anti-scale, antibacterial products or fragrances.

EXAMPLES

It has been observed experimentally that for ordinary washing machines, both front-loading and top-loading ones, the dosing device according to the present invention ensures perfect cleanliness of the washing machine without compromising the washing efficiency of the washed items.

Figure 8:
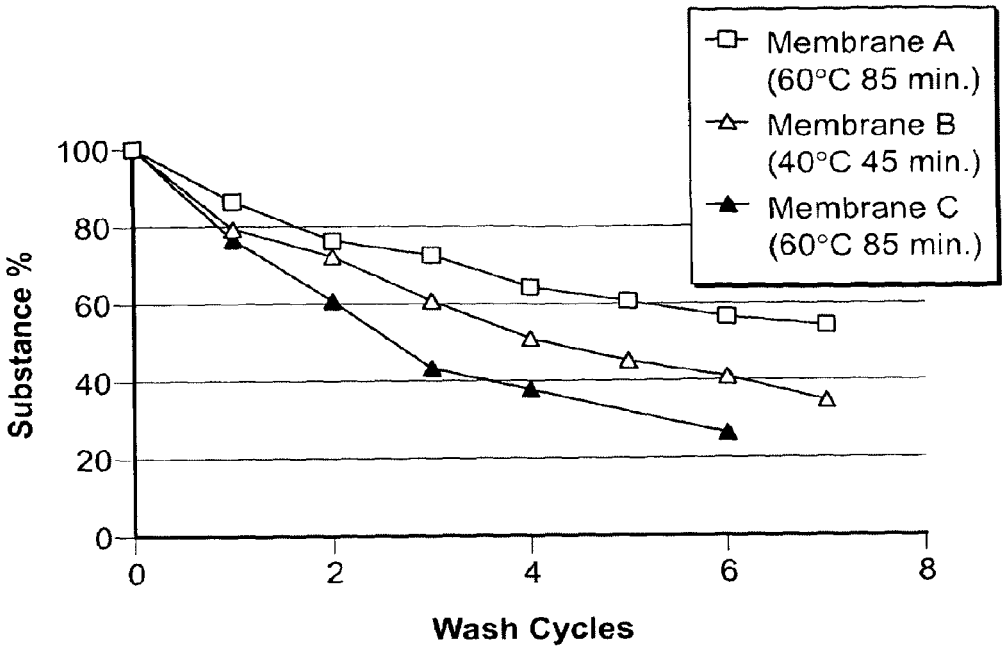
FIGS. 8 and 9 are diagrams representing the substance-release conditions by the dosing device of the invention in some tests carried out in washing machines.
Figure 9:
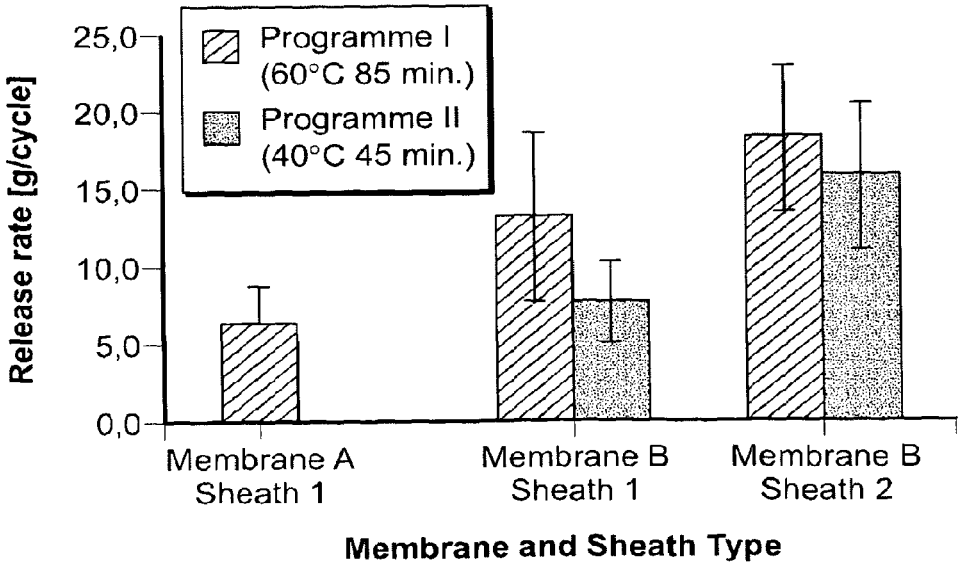

FIGS. 8 and 9 report the results of some release tests of an antiscale agent from a dosing device according to the invention installed in the seal of an Indesit washing machine, model WIXL 125 with front-opening, using two different wash programmes two different types of cellulose membrane as casing 2 of the device.

A first wash programme provides a maximum washing temperature of 60° C. and a duration of the wash cycle of 85 minutes. A second wash programme provides instead a lower maximum wash temperature, equal to 40° C., and a shorter duration of the wash cycle, equal to 45 minutes.

A first type of membrane used for forming the casing (shown in the diagrams as membrane A) is a cellulose-based membrane, of the type used for controlled porosity osmosis, A second type of membrane (shown in the diagrams as membrane B) is instead an ordinary, cellulose-based membrane with a greater porosity than membrane A.

The assessment of the softening effect on the wash water has been assessed by measuring the release rate of the antiscale agent rather than with a direct assessment of wash water hardness, in consideration of the fact that such hardness depends also on other factors and cannot hence represent an exact indication of device operation. The substance release rate has been calculated on the basis of the weight change of dosing device 1 at each washing cycle, taking into account the percentage ratio substance/water found on each occasion within the device, which ratio, as a matter of face, varies during the use of the device upon decreasing of the concentration or of the substance amount.

As can be noticed examining the diagrams of FIGS. 8 and 9, the percentage of substance decreases with the number of washing cycles. The decrease is faster in the first few washing cycles and tends to stabilise at a constant value during the subsequent washes, so that the release rate does not substantially depend on the left-over amount of substance within the device, and for each washing cycle it is hence possible to obtain a release rate above a present minimum dose, until depletion of the device.

A depletion indicate of the charge of substance 3, or an end of life indicator, for example a visual or sound one, in any case informs the user of the need to replace or recharge the device, before the release rate for each washing cycle drops below said minimum dose.

By examining in particular the diagram of FIG. 9, it can be detected that the release rate—in addition to the fact that it obviously has higher values depending on the wash temperature and on the duration of the washing cycle-may be remarkably changed a priori both by acting on the type of membrane, and on the shape of the sheath 16 used for protection of casing 2, in particular by changing the shape and arrangement of the areas of cashing 2 not covered by sheath 16, through which areas access to the wash water in the gap between sheath 16 and casing 2 is provided. In the diagram of FIG. 2, sheath no. 1 has a wash water access surface smaller than that of sheath no. 2.

Moreover, since some parts of the electrical household appliances—such as for example the seals-are prone to water accumulation and stagnation, wherein moulds may develop and bacteria may proliferate if no thorough and constant cleaning is regularly performed, the additional presence of an antibacterial or anti-mould substance among the various components of the substance 3 contained in the device of the invention guarantees the constant contact thereof with similar elements, and hence a good cleanliness of the electric household appliance. In this way the user is not forced to remember also to clean and dry thoroughly some parts of the electric household appliance.

The device thus covered is clearly susceptible of industrial application; it may also be subject to a number of changes and variations, all falling within the scope of the invention; moreover, all the details may be replaced by technically equivalent elements, the scope of the invention being exclusively defined in the accompanying claims.

The invention claimed is:

1. A gradual-release dosing device adapted for providing at least one substance in a domestic-use apparatus comprising the presence of a water based work fluid, wherein the said dosing device comprises a casing within which a plurality of doses of said substances is contained, necessary for the corresponding plurality of operation cycles of said apparatus, said casing being at least partly defined by a material permeable to said work fluid and capable of releasing at least a dose of said substance at each operation cycle of the apparatus, wherein the substance comprises at least one washing-active, dishwashing-active or cleaning-active preparation from the group consisting of surfactants, builders, water softening agents, zeolites, silicates, polymers, carbonates, carboxylates, sulphonates, bleaching agents, bleach activators, bleach stabilizers, bleach catalysts, cobuilders, alkalizing agents, acidifying agents, redeposition inhibitors, dyes, fragrances, optical brighteners, UV filters, fabric softeners, and rinse agents, and wherein the casing comprises a safety aperture.

2. A gradual-release dosing device according to claim 1, wherein said permeable material is a polymeric membrane which, upon contact with said work fluid, allows contact of the fluid with the substance contained therein to release at least one dose of said substance during each operation cycle of said apparatus, by dissolution of suspension of the substance in the work fluid, maintaining substantially unchanged the chemical properties of the remaining doses of said substance contained in the casing.

3. A gradual-release dosing device according to claim 2, wherein the said polymeric membrane is a hydrophilic cellulose membrane.

4. A gradual-release dosing device according to claim 2, wherein the said polymeric membrane is a hydrophilic cellulose membrane.

5. A gradual-release dosing device according to claim 1, wherein said casing has an elongated tubular shape.

6. A gradual-release dosing device according to claim 1, wherein the ratio between the length and the diameter of said casing is above 4.

7. A gradual-release dosing device according to claim 1, further, comprising a water-proof protective sheath which covers, at least partly, said casing of the permeable material.

8. A gradual-release dosing device according to claim 7, wherein the said casing is flexible and deformable.

9. A gradual-release dosing device according to claim 8, wherein said sheath is flexible and comprises at least one joint which allows an angular deformation of the device to shape the said device according to the geometry of the respective seat of said apparatus into which the device is housed.

10. A gradual-release dosing device according to claim 9, wherein at least one fastening means is provided to securely fasten the device into the housing seat of said apparatus, said seat being affected, during operation of the apparatus, by said work fluid and, preferably, being easy to be inspected by a user.

11. A gradual-release dosing device according to claim 10, wherein said seat consists of a seal inside the apparatus.

12. A gradual-release dosing device according to claim 1 which further comprises an indicator to signal the depletion of the substance.

13. A gradual-release dosing device according to claim 12, wherein said indicator is a visual indicator consisting of the colour change exhibited by said substance upon the progressive depletion thereof.

14. A gradual-release dosing device according to claim 1, wherein said substance contained in the casing is in a liquid or gel form exhibits a progressive concentration drop upon each operating cycle.

15. A gradual-release dosing device according to claim 1, wherein said substances contained in the casing is solid form, in powder or pellets, both fluid and agglomerated, which is dissolved in the subsequent washing cycles showing progressive quantity drop at each operation cycle.

16. A gradual-release dosing device according to claim 1, wherein said substance contained in the casing consists of a part in a solid form and a part in a liquid or gel form, wherein the parts are mixed with each other.

17. A gradual-release dosing device according to claim 1, wherein said dose substance released during each operation cycle of the apparatus may be adjusted at will by changing the porosity of the permeable membrane which makes up the casing.

18. A gradual-release dosing device according to claim 1, wherein said does of substance released during each operation cycle of the apparatus may be adjusted at will by changing the configuration and the size of the areas of the said casing not covered by said sheath.

19. A gradual-release dosing device according to claim 1, wherein the device comprises a plurality of compartments to house the substance.

20. A gradual-release dosing device according to claim 19, wherein each compartment houses a different substance.

21. A method of removing and preventing the deposit of limescale in a clothes washing machine during the use of the machine in a process of washing clothes, the method including the step of:

providing to the clothes washing machine a device according to claim 1.

22. A gradual-release dosing device according to claim 1, wherein the safety aperture has a dimension of between 1-100 μm.

23. A seal of a domestic-use washing apparatus which washing apparatus comprises the presence of a water-based work fluid, characterized in that the said washing apparatus comprises a casing of permeable material containing a substance inside, at least one dose of said substance being releasable during an operation cycle of the apparatus, and further wherein the casing includes at least one safety aperture.

24. A seal according to claim 23, wherein said casing is rechargeable with said substance through one or more inlets.

25. A seal according to claim 23, wherein the safety aperture has a diameter of between 1-100 μm.

* * * * *